United States Patent [19]

Johnson et al.

[11] Patent Number: 4,508,238

[45] Date of Patent: Apr. 2, 1985

[54] NEWSPAPER VENDING MACHINE

[76] Inventors: Nathan D. Johnson, 9808 Knox, Overland Park, Kans. 66212; James D. Sampson, 435 Camden; Darwin L. Sampson, 1701 Upper Mill Ter., both of Salina, Kans. 67401

[21] Appl. No.: 398,098

[22] Filed: Jul. 14, 1982

[51] Int. Cl.[3] ..... G07F 11/12

[52] U.S. Cl. ..... 221/107; 221/213; 221/232; 221/245

[58] Field of Search ..... 221/17, 92, 93, 103, 221/107, 108, 151, 155, 210, 213, 232, 241, 224, 245, 281; 194/DIG. 12

[56] References Cited

U.S. PATENT DOCUMENTS

| | | | |
|---|---|---|---|
| 840,281 | 1/1907 | Abel | 194/DIG. 12 |
| 3,709,405 | 1/1973 | Harris | 221/232 X |
| 3,747,733 | 7/1973 | Knickerbocker | 221/103 X |
| 4,273,255 | 6/1981 | Overall | 221/213 |
| 4,319,695 | 3/1982 | Dutro | 221/213 |

*Primary Examiner*—Joseph J. Rolla
*Assistant Examiner*—G. Pyryt
*Attorney, Agent, or Firm*—Kokjer, Kircher, Bradley, Wharton, Bowman & Johnson

[57] ABSTRACT

A single copy newspaper vending machine which dispenses one newspaper copy each time proper coins are deposited. Newspapers are stacked on a tray which is urged upwardly toward a ski device that rides on the newspaper stack. The ski device can be pulled forwardly to dispense a single newspaper by depositing proper coins and pulling on the handle of a slide arm. The slide arm is normally locked in a retracted position but is released when the coins are accepted. The ski device includes pointed prongs which penetrate the upper surface of the top newspaper in the stack. The back folded edge of the top newspaper is engaged by cleats projecting from a cleat plate carried on the ski device. A pivotal dog member assures that the slide arm is moved through a single complete stroke each time it is released. After the stack of newspapers on the tray has been exhausted, the next stroke of the slide arm causes the dispensing of a display copy carried in a display case on the front of the machine.

14 Claims, 13 Drawing Figures

Fig. 1.
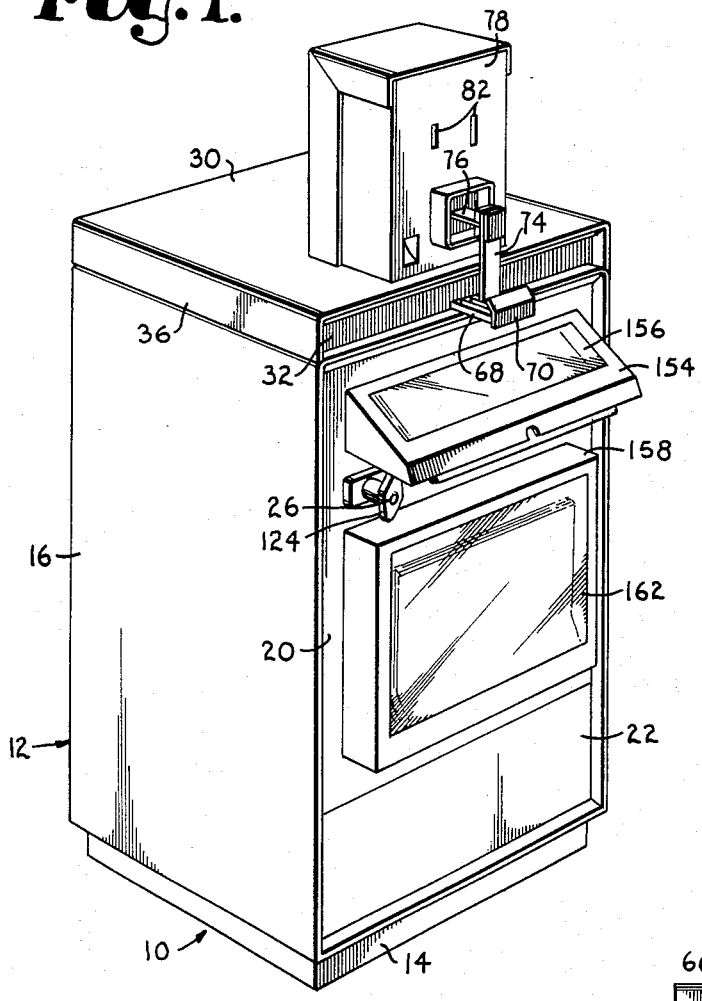
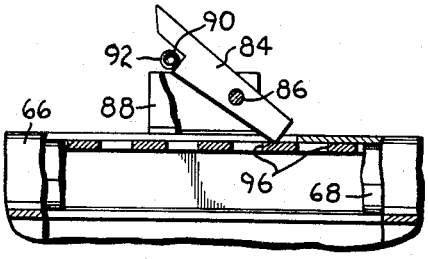
Fig. 6.
Fig. 7.
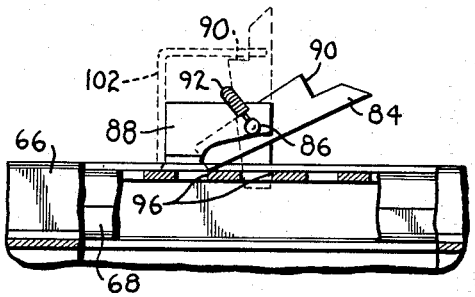
Fig. 8.
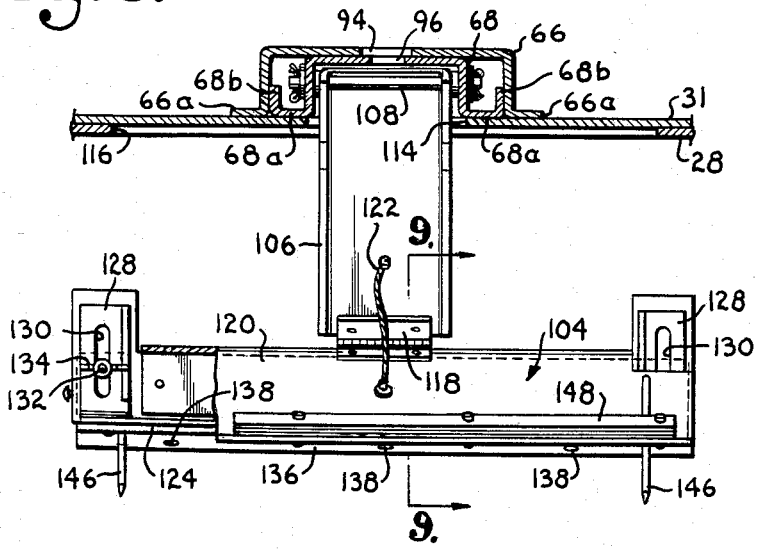

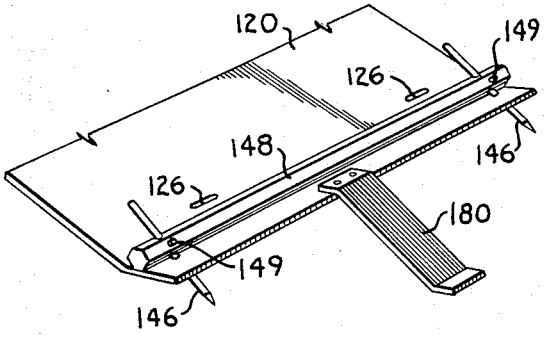
Fig. 10.
Fig. 11.
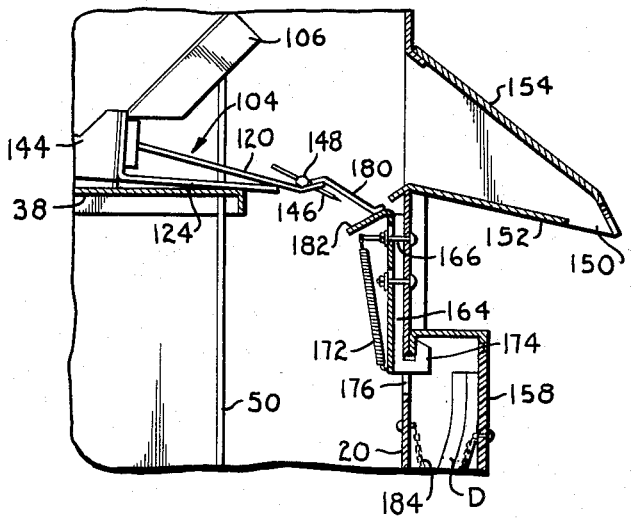
Fig. 12.
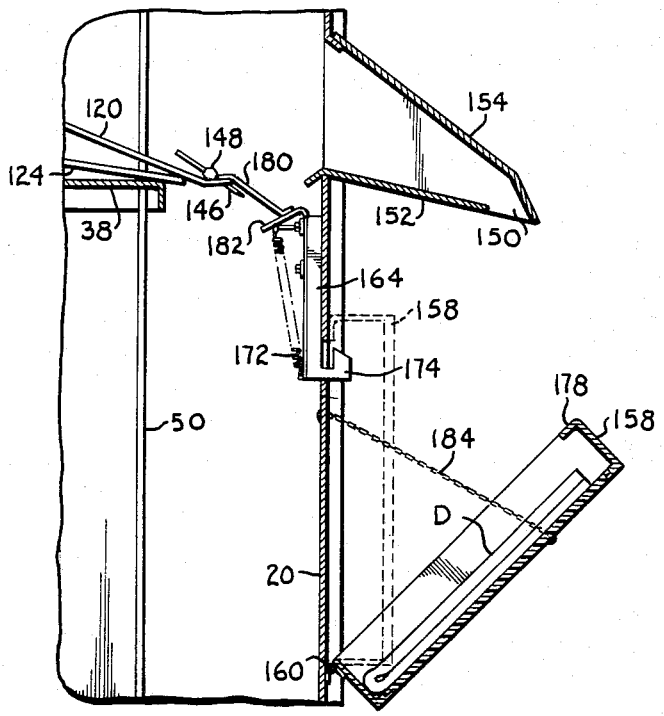
Fig. 13.
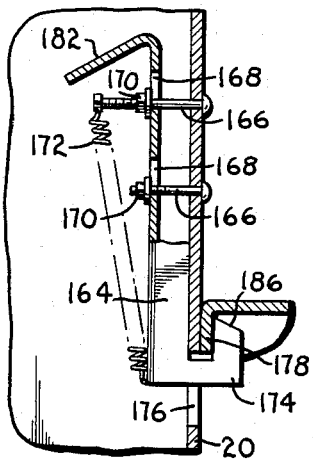

NEWSPAPER VENDING MACHINE

BACKGROUND AND SUMMARY OF THE INVENTION

This invention relates generally to vending machines and more particularly to a coin operated newspaper vending machine that dispenses one newspaper copy at a time.

The most common newspaper vending machine is in essence simply an enclosed box having a normally locked door that can be opened after the proper coins have been deposited in a coin mechanism on the machine. Each time the door is opened, access is provided to the entire supply of newspapers in the box, and it is not at all unusual for more than one newspaper to be removed at a time. As can easily be appreciated, considerable revenue can be lost as a result of failure to pay for all of the copies in the machine.

The unsatisfactory nature of conventional newspaper vending machines has long been recognized, but to date there has not been available a satisfactory machine that dispenses only a single paper each time correct coins are deposited. Machines such as those disclosed in U.S. Pat. Nos. 4,199,077 to Lacewell; 3,917,114 to Grosse; and 3,263,859 to Searle are characterized by excessive complexity and are unduly expensive both to construct and maintain. The single copy machines that have been proposed in the past are also susceptical to jamming and to other malfunctions such as the delivery of more than one newspaper at a time. When jamming of the paper feed mechanism and similar malfunctions occur, customers become frustrated and often take out their frustrations by damaging the vending machine.

Newspaper vending machines ordinarily provide a display copy of each newspaper issue so that the front page is prominently displayed to attract the attention of passersby. In single copy machines, the display copy is not always dispensed since it is separated from the remainder of the copies which are normally arranged in a stack in the machine. The display copy is thus useful only for display purposes and its cost is not recovered through sale by the vendor. The loss of revenue caused by the inability to sell the display copies becomes particularly significant when a large number of machines are involved.

In view of the foregoing problems associated with newspaper vending machines, it is evident that a need exists for a single copy machine that operates a simple and reliable manner to dispense one newspaper at a time while denying access to the remaining newspapers. It is the primary goal of the present invention to meet that need.

More specifically, it is an object of the invention to provide a coin operated newspaper vending machine that dispenses one newspaper each time the appropriate coins are deposited.

Another object of the invention is to provide, in a single copy newspaper vending machine, an improved paper feeding mechanism that feeds one and only one newspaper to the outlet slot for each set of coins that are properly deposited. The ski device which feeds the papers is equipped both with pointed prongs that penetrate the top surface of the newspaper and with cleats that engage the back edge of the paper to assist in the feeding operation. As a result, misfeeds are minimized, and both jamming of the machine and inadvertent dispensing of multiple copies are virtually eliminated.

Yet another object of the invention is to provide a machine of the character described that is capable of properly handling newspapers that vary widely in thickness. The position of the cleats relative to the thickness of the newspaper is adjustable so that both relatively thin daily papers and much thicker Sunday or special editions can be readily accommodated.

A further object of the invention is to provide a single copy newspaper vending machine wherein a prominently exhibited display copy is dispensed after the remainder of the newspaper supply has been exhausted. Increased revenue is thus achieved because the display copy of each issue can be sold along with the remainder of the newspaper supply.

An additional object of the invention is to provide a machine of the character described which is simple and economical to construct and maintain and which has a the capacity to hold a large number of newspapers.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a perspective view of a single copy newspaper vending machine constructed according to a preferred embodiment of the present invention;

FIG. 6 is a fragmentary side elevational view on an enlarged scale taken generally along line 6—6 of FIG. 2 in the direction of the arrows, with portions broken away to illustrate the position of the pivotal dog member during forward movement of the slide arm toward the extended position;

FIG. 7 is a fragmentary side elevational view similar to FIG. 6 but showing the position of the dog member during rearward movement of the arm toward the retracted position, with the broken lines illustrating the dog member in a vertical position;

FIG. 8 is a fragmentary sectional view on an enlarged scale taken generally along line 8—8 of FIG. 2 in the direction of the arrows, with portions broken away for purposes of illustration;

FIG. 10 is a fragmentary perspective view of the top portion of the ski member which acts to dispense the newspapers in the machine;

FIG. 11 is a fragmentary sectional view similar to FIG. 4 but showing the ski member approaching the latch for the display case after the final newspaper has been dispensed from the newspaper tray;

FIG. 12 is a fragmentary sectional view similar to FIG. 11, but showing the latch released to open the display case for dispensing of the newspaper display copy; and FIG. 13 is a fragmentary sectional view of the latch on an enlarged scale, with a portion broken away for purposes of illustration.

DETAILED DESCRIPTION OF THE INVENTION

Figure 2:
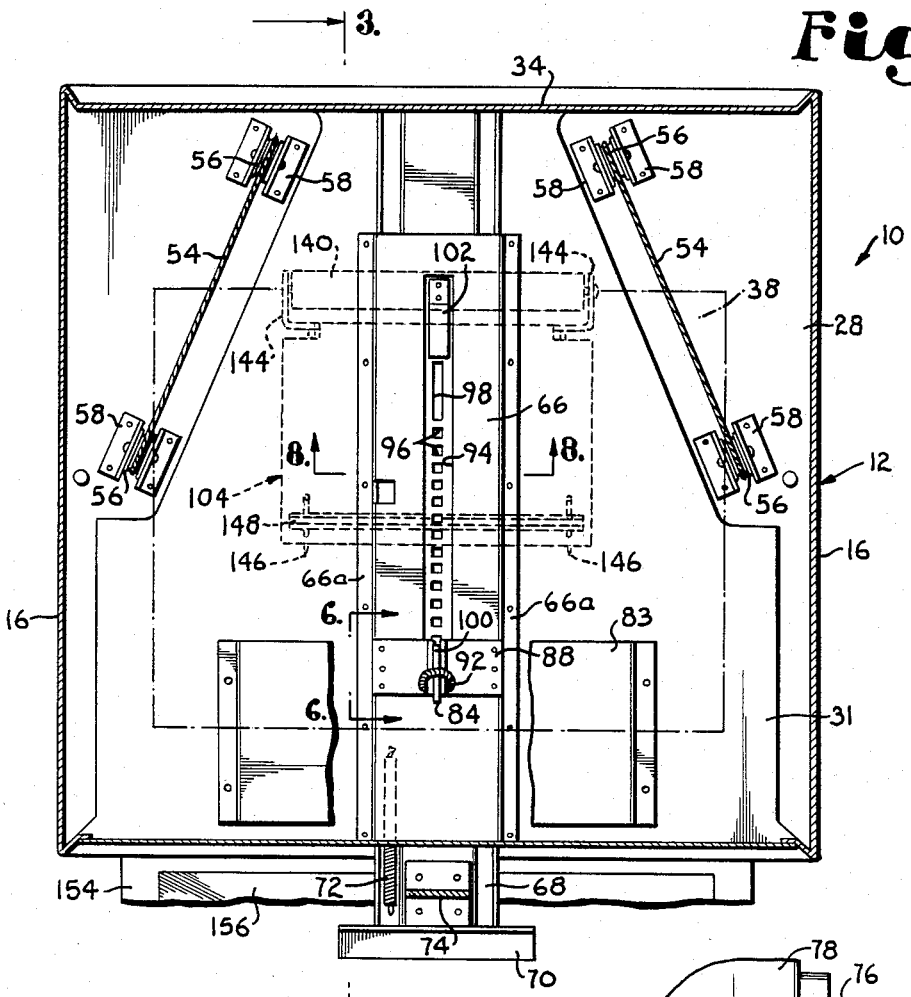
FIG. 2 is a top plan view of the machine, with the hood removed and portions broken away for purposes of illustration.
Figure 3:
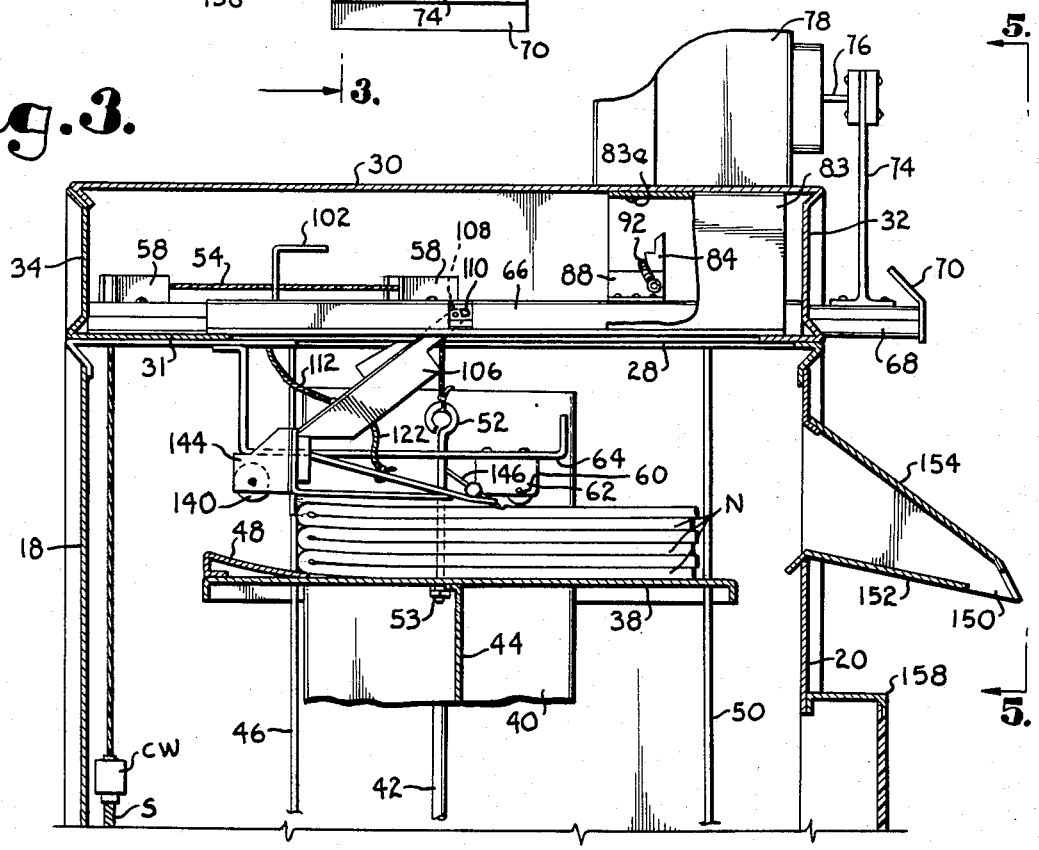
FIG. 3 is a fragmentary sectional view taken generally along line 3—3 of FIG. 2 in the direction of the arrows, with portions broken away for purposes of illustration and the slide arm retracted in the idle position of the machine.

Referring now to the drawings in more detail and initially to FIGS. 1–3, numeral 10 generally designates a single copy newspaper vending machine constructed in accordance with the present invention. The machine has a rectangular, boxlike housing 12 mounted on a base 14 which may be weighted down with concrete or other weighted material for stability. The housing is formed by a pair of opposite side panels 16, a back panel 18, and a hinged door 20 located above a kick plate 22 on the front of the machine. The door 20 is hinged to the right side panel and is normally locked in a closed position by a suitable lock mechanism (not shown). The lock mechanism is operated by a handle 124 having a keyhole 26 for receiving a key which is used to unlock the handle and permit it to be turned for opening of the door. When the door is opened, access is provided to the interior of the housing so that a supply of newspapers may be loaded into the machine.

The housing 12 of the machine has a top panel 28 which is normally covered by a hood 30. Secured on top of panel 28 is an irregular plate 31. Extending upwardly from the front and back edges of plate 31 are short front and back walls 32 and 34, respectively, which cooperate with the hood 30 to form an enclosed compartment above the top panel of the housing. Hood 30 has side walls 36 which essentially form upward continuations of the housing side panels 16. Hood 30 is suitably secured on top of the housing, as by screws or other fasteners (not shown).

Mounted within housing 12 is a newspaper tray 38 having a horizontal surface for receiving and holding a stack of newspapers N. Secured to the opposite side edges of tray 38 are vertical side plates 40. Extending through a pair of bushings (not shown) secured to each of the side plates 40 are vertical guide posts 42. There are two guide posts 42, and each is secured at its bottom end to the bottom of the housing and extends upwardly through the top panel 28 at its top end. The guide posts 42 maintain tray 38 in a horizontal orientation and limit the tray to up and down movement in the housing. Secured to the underside of tray 38 is a base plate 44 which extends between the side plates 40.

The newspapers deposited on tray 38 engage at their back edges a pair of vertical rods 46 which are suspended from the top panel 28. Rods 46 extend through openings formed in tray 38 near its back edge. Located between rods 46 is optionally located a small ramp 48 on which the back edge portions of the newspapers are received. Also suspended from the top panel 28 is another pair of rods 50 located well ahead of rods 46. Rods 50 extend through openings formed in tray 38 near its front edge. Rods 50 limit sideward movement of the newspapers on tray 38.

Alternatively, the spring assembly may be located in the bottom of the housing, or other suitable location, by providing additional pulleys and extending the length of the cables 54. The intent, therefore, is simply to supply an appropriate tension force to cables 54 for counterbalancing the weight to the newspaper stack.

A pair of eye bolts 52 are secured to tray 38 near its opposite sides by nuts 53 threaded onto the lower ends of the bolts. Cables 54 are tied to the eye bolts 54 and extend upwardly through panel 28 into the compartment located above it. Each cable 54 is passed around a pair of pulleys 56 which are each mounted for rotation between a pair of brackets 58 secured on the top panel 28. After passing around the pulleys, each cable 54 extends back downwardly into the rear portion of the housing, as best shown in FIG. 3. The lower ends of the cables are secured to a counterweight CW which is continuously urged downwardly by suitable springs S tied at their upper ends to the counterweight and at their lower ends to the bottom of the housing. The counterweight and spring continuously urge tray 38 upwardly within the housing.

A pair of roller assemblies each including a set of four rollers 60 limit upward movement of the newspaper tray 38. Each set of rollers 60 is mounted for rotation on a bracket 62 which is in turned carried on an arm 64. Each arm 64 has a horizontal portion on which bracket 62 is mounted and a vertical portion which is secured at its upper end to the underside of the top panel 28. One set of rollers 60 is located above each side edge portion of tray 38 so that the top newspaper in the stack deposited on the tray is engaged by the rollers 60. The rollers limit upward movement of tray 38 and facilitate dispensing of the newspapers, as will be more fully explained. Rollers 60 may, of course, be replaced by bar material or other structural element to bear against the topmost newspaper.

Figure 4:
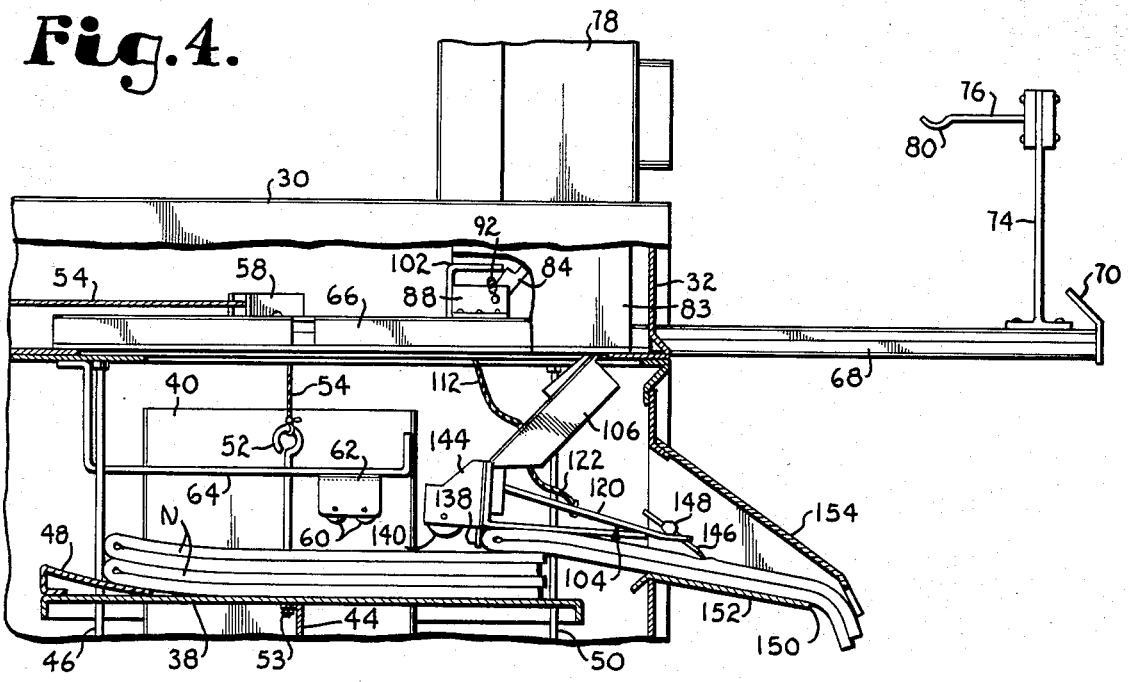
FIG. 4 is a fragmentary sectional view similar to FIG. 3, but with the slide arm extended to dispense a newspaper copy.
Figure 5:
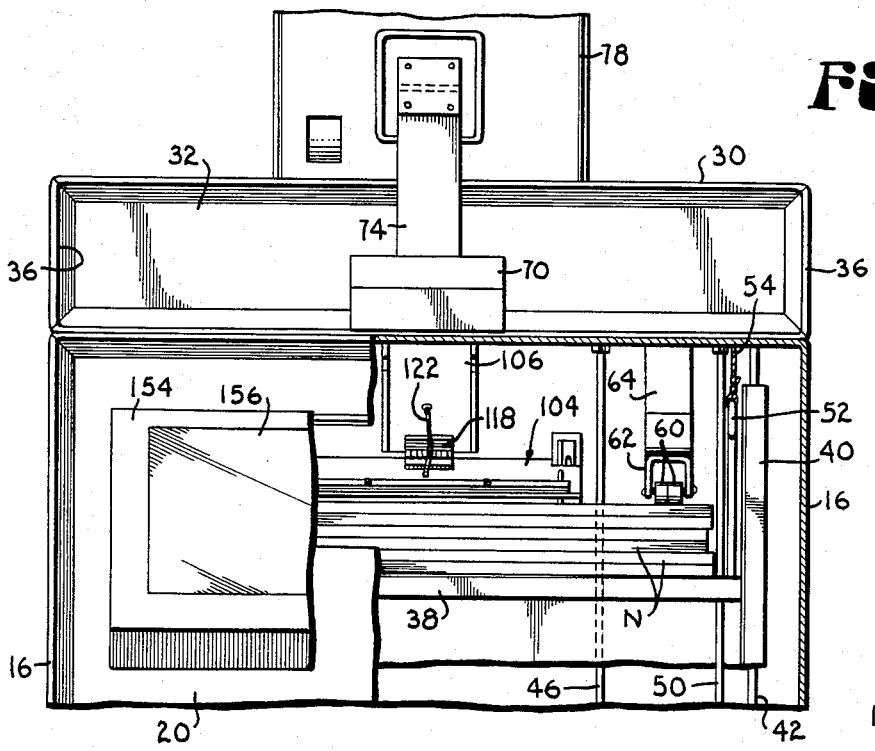
FIG. 5 is a fragmentary front elevational view taken generally along line 5—5 of FIG. 3 in the direction of the arrows, with portions broken away for purposes of illustration.

Secured to the upper surface of the irregular plate 31 is an inverted channel 66 which forms a track guiding the movement of a slide arm 68. Channel 66 has flanges **66*a* on its opposite sides which are secured to plate 31. The slide arm 68 extends within channel 66, and its front end portion projects through an opening in wall 32. The front end of arm 68 is thus accessible from the exterior of the machine and is provided with a handle 70 which facilitates pulling of the arm forwardly. As shown in FIG. 8, arm 68 has the general shape of a channel having flanges 68*a* which ride on top of plate 31. Upturned lips 68*b* ride against the opposite sides of channel 66, while the horizontal web portion of arm 68 contacts the underside of the web of channel 66. Channel 66 provides a track which limits arm 68 to sliding movement lengthwise of the arm between the retracted position shown in FIG. 3 and the extended position shown in FIG. 4. A tension spring 72 (FIG. 2) is hooked to channel 66 at its back end and to arm 68** at its front end to continuously urge the slide arm rearwardly toward its fully retracted position.

The slide arm 68 is normally locked in the fully retracted position. The front end portion of arm 68 which projects out of the machine is provided with an upstanding bracket 74. Extending rearwardly from the upper end of bracket 74 is a tongue 76. When arm 68 is in the fully retracted position, tongue 76 extends into a coin box 78 which is mounted on top of the hood 30. A latching portion 80 (FIG. 4) of tongue 76 is then engaged by a latch (not shown) which is located within the coin box 78 and which holds tongue 76 in place to prevent arm 68 from being pulled forwardly. The coin box 78 has a pair of coin slots 82 into which coins can be deposited. The coin box also has a suitable coin mechanism (not shown) which accepts proper coins and releases the latch in response so that the latching portion 80 of tongue 76 is released to permit arm 68 to be pulled forwardly. When the arm returns to the fully retracted position, the latch automatically engages portion 80 of the tongue to lock the slide arm in place.

The coin box 78 is supported on a bracket 83 which is secured to plate 31 at its lower end and provides at its upper end a flat surface beneath the top of hood 30. Bolts 83*a* (FIG. 3) extend upwardly through the top of bracket 83 and hood 30 into the coin box and receive nuts which can be loosened only from the inside of the coin box. Thus, the coin box must be opened (by a key) before the nuts can be removed to release the coin box and permit removal of the hood 30.

A pivotal dog 84 limits the slide arm 68 to one complete stroke from the retracted position to the extended position and back to the retracted position each time proper coins are deposited in the coin box. The dog 84 is mounted to pivot about a horizontal pin 86 extending between a pair of brackets 88 that are mounted to the top of channel 66 near its forward end. The upper portion of dog 84 is notched at 90. The dog is bottom heavy and tends to assume a vertical position with the notched end above the pivot pin 86. An optional spring 92 is formed in a U shaped configuration and is secured at its opposite ends to the ends of the pivot pin 86. When the slide arm 68 is being pulled forwardly from the retracted position toward the extended position, spring 92 is received in notch 90 as shown in FIG. 6 and acts to urge the bottom end of dog 84 downwardly against the top surface of the slide arm. When the slide arm is moving rearwardly from the extended position toward the retracted position, spring 92 is disengaged from dog 84 and the dog is inclined in the position shown in the solid line view of FIG. 7.

As best shown in FIG. 2, the upper surface of channel 66 is provided with an elongated slot 94 through which the lower end of dog 84 projects. The upper surface of slide arm 68 is provided with a series of square holes 96 which are arranged in a straight row below the slot 94. An elongated slot 98 is formed in arm 68 at the back end of the row of openings 96, and a similar slot 100 is formed in the slide arm at the front end of the row of openings. Slot 100 underlies dog 84 when the slide arm 68 is in the fully retracted position, and the other slot 98 underlies the dog when the slide arm is pulled forwardly to its fully extended position.

An L shaped bar 102 serves as a trip which contacts the upper end of dog 84 when arm 68 has reached the fully extended position. Bar 102 is secured to the top surface of arm 68 with a horizontal portion of the bar spaced well above the arm at a location to contact the top end of dog 84. The bar 102 moves within slot 94 as the slide arm is extended and retracted. Alternatively, both spring 92 and bar 102 may be omitted from the construction when dog 84 is heavily bottom weighted (i.e., the pivot point of the dog 84 is offset from the centroid of the member) so as to be vertically oriented when not in contact with the top surface of the slide arm.

The newspapers are dispensed by a carriage in the form of a ski device 104 which rides on top of the stack of newspapers deposited on tray 38. An inclined arm 106 links the ski 104 with arm 68 so that the ski moves forwardly and rearwardly with the slide arm during extension and retraction thereof. The connecting arm 106 is a channel member having its top end pivotally pinned to arm 68 by a horizontal pivot pin 108. The pivot pin 108 extends through elongated slots 100 (FIG. 3) formed in the opposite sides of arm 68. The slots 110 provide a limited amount of play between the slide arm 68 and the connecting arm 106. A cable 112 is connected to the slide arm 68 at its upper end and to the connecting arm 106 at its lower end to limit the downward pivoting of arm 106.

As best shown in FIG. 8, the connecting arm 106 extends through a slot 114 formed in plate 31 and through a larger opening 116 formed in the top panel 28 of the housing. The lower end of arm 106 is connected by a hinge 118 with a top plate 120 of the ski 104. A cable 122 is connected at its top end with arm 106 and at its bottom end with the top plate 120 to limit downward pivotal movement of the ski relative to the connecting arm. In this manner, ski 104 is suspended from the slide arm 68, and limited pivotal movement is permitted about the pivot pin 108 and the hinge 118.

Figure 9:
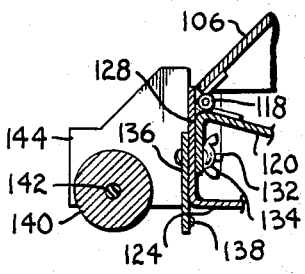
FIG. 9 is a fragmentary sectional view taken generally along line 9—9 of FIG. 8 in the direction of the arrows.

In addition to the top plate 120, ski 104 includes a sole plate 124 which engages the top newspaper in the stack. The front edge of plate 124 carries a pair of tabs which fit through openings 126 (FIG. 10) in the top plate 120 to connect the front portions of the two plates. As best shown in FIGS. 8 and 9, the back edge of the sole plate 124 has a pair of upstanding lugs 128 each provided with a vertically elongated slot 130. Lugs 128 are secured to the back edge portion of the top plate 120 by a pair of bolts 132 which receive wing nuts 134. The bolts and wing nuts also mount a clear plate 136 behind the lugs. The cleat plate 136 normally extends slightly below the sole plate 124 and includes a plurality of pointed cleats 138 near its lower edge at a location below the sole plate. The cleats 138 project forwardly from the clear plate and engage the back edge portion of each newspaper which is dispensed by the ski device.

The bolts 132 extend through the elongated slots 130. Consequently, when the wing nuts 134 are loosened, the sole plate 124 can be adjusted up or down relative to the remainder of the ski assembly, with slots 130 accommodating movement of bolts 132 therein. Movement of the sole plate adjusts the distance between it and the pointed cleats 138 so that for any newspaper thickness handled by the machine, adjustment can be made to position the cleats slightly below center on the back edge of each newspaper. Tightening of the wing nuts 134 secures the sole plate 134 at the desired position.

The rear portion of the ski assembly 104 carries a cylindrical roller 140. The roller 140 is mounted for rotation on an axle 142 extending between a pair of brackets 144. The brackets extend rearwardly from the top plate 120 of the ski assembly.

The forward end of the ski 104 is provided with a pair of pointed spikes or prongs 146. The prongs are connected with a bar 148 secured to the top surface of plate 120 near its forward end. The prongs 146 angle forwardly and downwardly from bar 148 and extend through the front portion of the top plate 120. Each prong terminates in a pointed tip which penetrates the newspapers in order to dispense them one at a time in cooperation with the cleats 138. Each prong is held in place by a set screw 149 (FIG. 10) which is threaded into bar 148 and against the prong, and which can be loosened to permit adjustment of the distance the prong projects from the ski.

The ski device 104 feeds the newspapers one at a time through an outlet slot 150 formed on the front of the machine between an inclined plate 152 and a hood 154 which overlies the plate. The plate 152 and hood 154 are both secured near the top of the door 20. Plate 152 inclines downwardly somewhat to provide a chute for feeding of the papers toward the outlet slot 150. The top of the hood 154 inclines more drastically so that the area between the hood and plate is gradually reduced as the slot 150 is approached. The slot is large enough to receive even the thickest newspapers and yet is small enough to prevent customers from reaching through with their hands. The hood 154 has opposite sides and a transparent window 156.

The door 20 carries a display case 158 below plate 152. As shown in FIG. 12, the bottom of the display case is connected with the door of the machine by a hinge 160. The front of the display case includes a transparent window 162 through which a newspaper display copy D deposited within the case can be viewed.

The display case 158 is normally held in a closed position on the door by a latch 164. As best shown in FIG. 13, the latch 164 is mounted against the inside surface of door 20 by a pair of bolts 166 which extend through vertically elongated slots 168 in the latch. Nuts 170 are threaded onto the bolts 166. The slots 168 permit latch 164 to slide upwardly and downwardly to a limited extent. The latch is continuously urged upwardly to the latching position shown in FIG. 13 by a tension spring 172 which is connected with the latch at its lower end and with one of the bolts 166 at its upper end.

The latching action is provided by a hook portion 174 formed on the bottom end of latch 164. The hook portion 174 extends through a small opening 176 formed in door 20. In the latching position, hook 174 engages a down turned lip 178 formed on the display case and thus holds the display case closed against the door. In the closed position of the display case 158, the display copy D contained therein is inaccessible but is prominently displayed through the window 162.

Unlatching of the display case is effected by a tongue 180 carried on the ski device 104 and projecting fowardly from the top plate 120. The tongue 180 acts against a flange 182 formed on the top of latch 164. When the tongue pushes against flange 182, latch 164 is pushed downwardly against the force of spring 172 to the release position shown in FIG. 12. In this position, hook 174 releases from lip 178, and the display case 158 drops forwardly about the hinge 160.

A chain 184 is tied at one end to door 20 and at the opposite end to the display case to prevent the display case from dropping beyond the position shown in solid lines in FIG. 12. This is the open position of the display case, and access is provided to the newspaper display copy D through the open back of the display case. The display case can be returned to the closed position simply by lifting it until lip 178 contacts the door surface. The hook portion 174 of the latch has a beveled surface 186 against which the lip 178 pushes to force the latch downwardly so that lip 178 can pass the hook portion 174 of the latch. Once this occurs, spring 176 pulls the latch upwardly to the latching position in order to hold the display case closed.

In operation of the machine, loading is accomplished by unlocking handle 124 and opening the door 20 so that a stack of newspapers N can be deposited on the tray 38. A single display copy D of the newspaper is deposited in the display case. It should be noted that a newspaper to be dispensed from a vending machine has at least one, but normally two folded edges. As shown in FIG. 3, the newspapers stacked on tray 38 are oriented such that one folded edge of each newspaper is located toward the back and positioned against rods 46. After the machine has been loaded with the desired number of newspaper copies, door 20 is closed and locked in the closed position. Display case 158 is latched in the closed position by latch 164.

A customer desiring a newspaper deposits the appropriate coins in the coin slots 82, thereby effecting release of the tongue 76. Handle 70 can then be pulled forwardly to move the slide arm 68 to its fully extended position. The linkage arm 106 pulls ski 104 forwardly with the slide arm to effect feeding of the top newspaper in the stack toward the outlet slot 150. The cleats 138 dig into the back folded edge of the top newspaper, and the pointed prongs 146 penetrate the upper surface of the newspaper to securely grip it and move it forwardly with the ski. When the slide arm 68 is in the fully extended position, the ski 104 is in the position shown in FIG. 4 to feed the leading edge portion of the newspaper through the outlet slot. The customer can then remove the newspaper.

When the handle 70 is released, the return spring 72 returns the slide arm 68 to its fully retracted position. During retraction of the slide arm, the roller 140 of the ski device rolls along the upper surface of the top newspaper in the stack, and the cleats 138 drop behind the back edge of the top newspaper when the ski has been fully retracted. Since tray 38 is continuously urged upwardly, the top newspaper is maintained against the bottom surface of the sole plate 124.

When the slide arm 68 is being pulled from the retracted position toward the extended position, the pivotal dog 84 is in the position shown in FIG. 6. If the slide arm is released before reaching the fully extended position, the return spring 72 can return the slide arm only until the lower end of the dog 84 enters one of the openings 96. The dog then engages the edge of the opening and locks the slide arm against further retraction. Thus, once the slide arm has been partially extended, it cannot return to the retracted position.

When the slide arm reaches the fully extended position, dog 84 is positioned with slot 98. The lower end of the dog moves in the slot 98 as the dog assumes the vertical position shown in broken lines in FIG. 7. When handle 70 is subsequently released so that the return spring can retract the slide arm, dog 84 assumes the position shown in solid lines in FIG. 7, and the influence of gravity maintains its lower end portion against the top of the slide arm. If an attempt is made to pull the slide arm forwardly before it has been fully retracted, the lower end of dog 84 drops into one of the openings 96 and engages the edge of the opening to lock the slide arm against extension.

When the slide arm reaches the fully retracted position, the tongue 76 is automatically locked in place, and dog 84 is located above slot 100. The dog then assumes the vertical position shown in broken lines in FIG. 7. When the arm is again extended, dog 84 is pivoted to the position shown in FIG. 6.

Thus, the slide arm 68 can be moved through only a single complete stroke from the retracted position to the extended position and back to the retracted position each time tongue 76 is released due to the deposit of coins in the coin box. One and only one newspaper is dispensed by the machine for each correct coin deposit.

After all of the newspapers N deposited on stack 39 have been dispensed, the next stroke of the slide arm causes the display copy D to be dispensed. When a newspaper is dispensed from tray 38, tongue 180 remains on top of the paper and is thus prevented from contacting the latch 164. However, when the supply of newspapers on tray 38 has been exhausted and ski 104 is moved forwardly, the leading end of tongue 180 approaches the flange 182 of the latch. Continued forward movement of the ski beyond the FIG. 11 position causes tongue 180 to push downwardly on flange 182, thus pushing latch 164 downwardly to the release position shown in FIG. 12. Hook 174 is then released from lip 178 of the display case, and gravity causes the display case to drop to the open position shown in solid lines in FIG. 12. The customer can then remove the display copy D from the rear of the display case. In this manner, the display copy of the newspaper is dispensed when proper coins are deposited after the stack of newspapers on tray 38 have been dispensed.

The inclined prongs 146, in cooperation with the cleats 138, securely grip the top newspaper in the stack in order to assure that the paper is properly fed through the outlet slot 150. The sole plate 124 is preferably adjusted such that the cleat plate 136 does not project beyond the bottom of the top newspaper in the stack and the cleats 138 penetrate the back edge of the top paper at approximately the center of its thickness or slightly below center. This prevents more than one paper from being dispensed at a time. The rollers 60 roll along the upper surface of the newspaper that is being dispensed to facilitate feeding of the newspaper toward the outlet structure.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A newspaper vending machine comprising:

a housing defining an enclosed interior and having a front portion presenting an outlet slot for dispensing newspapers one at a time;

a tray in said housing adapted to receive a stack of newspapers, said tray being supported within the housing for generally vertical movement;

a normally locked door on said housing providing access to the housing interior when open to permit a stack of newspapers to be deposited on said tray;

a slide arm supported on the housing for fore and aft sliding movement lengthwise of the arm between an extended position and a retracted position, said arm having an accessible front end projecting forwardly of said front portion of the housing and a handle on said front end for pulling the arm forwardly to the extended position;

means for biasing said slide arm toward the retracted position;

a carriage overlying said tray for feeding the newspapers one at a time to said outlet slot;

link means for flexibly suspending said carriage from said slide arm in a manner to move the carriage fore and aft in response to fore and aft movement of said arm, said link means including a link having an upper end pivotally coupled with said slide arm and a lower end coupled with said carriage;

yieldable means for urging said tray upwardly to maintain contact between said carriage and the top newspaper in the stack on said tray; and gripping means on said carriage for gripping the upper surface of the top newspaper in the stack in a manner to separate the top newspaper and feed the same to said slot in response to forward movement of the carriage effected by pulling of said slide arm from the retracted position to the extended position, whereby the top newspaper in the stack is delivered to said slot each time said slide arm is pulled to the extended position.

2. A machine as set forth in claim 1, including:

locking means for locking said slide arm in the retracted position;

coin operated means for releasing said locking means to permit extension of the slide arm from the retracted position;

means for preventing retraction of said slide arm when same has been extended from the retracted position and has not reached the extended position, said preventing means becoming ineffective when the slide arm has reached the extended position, thereby permitting said biasing means to move the arm from the extended position toward the retracted position; and means for preventing extension of said slide arm when same has been retracted from the extended position, whereby each time said coin operated means is operated, said slide arm is released for a single stroke from the retracted position to the extended position and back to the retracted position to effect delivery of the top newspaper to said slot.

3. A machine as set forth in claim 1, wherein said gripping means includes a pair of prongs on said carriage having pointed tips for penetrating the upper side of the top newspaper in the stack.

4. A machine as set forth in claim 3, wherein said gripping means further includes a plurality of cleats on said carriage for penetrating the back edge portion of the top newspaper in the stack.

5. A machine as set forth in claim 1, wherein said carriage comprises a ski device having a roller thereon rolling along the top newspaper in the stack during movement of the ski device to the rear when the slide arm is released for movement to the retracted position.

6. A machine as set forth in claim 5, wherein said gripping means includes a pair of prongs on said ski device oriented to extend forwardly and downwardly therefrom and terminating in pointed tips for penetrating the upper side of the top newspaper in the stack.

7. A machine as set forth in claim 6, wherein said ski device includes a sole plate for contact with the upper side of the top newspaper in the stack and said gripping means further includes a plurality of cleats on said ski device located below the sole plate for penetrating the back edge portion of the top newspaper in the stack.

8. A machine as set forth in claim 7, including means for adjusting the distance between said sole plate and cleats to accommodate the newspapers having various thicknesses.

9. A newspaper vending machine comprising:

a housing defining an enclosed interior and having a front portion presenting an outlet slot for dispensing newspapers one at a time;

a tray in said housing adapted to receive a stack of newspapers, said tray being supported within the housing for generally vertical movement;

a normally locked door on said housing providing access to the housing interior when open to permit a stack of newspapers to be deposited in said tray;

a slide arm supported on the housing for fore and aft sliding movement lengthwise of the arm between an extended position and a retracted position, said arm having an accessible front end projecting forwardly of said front portion of the housing and a handle on said front end for pulling the arm forwardly to the extended position;

means for biasing said slide arm toward the retracted position;

a carriage overlying said tray for feeding the newspapers one at a time to said outlet slot;

link means for flexibly suspending said carriage from said slide arm in a manner to move the carriage fore and aft in response to fore and aft movement of said arm, said link means including a link having an upper end pivotally coupled with said slide arm and a lower end coupled with said carriage yieldable means for urging said tray upwardly to maintain contact between said carriage and the top newspaper in the stack on said tray;

means on said carriage for engaging the top newspaper in the stack in a manner to separate the top newspaper and feed the same to said slot in response to forward movement of the carriage effected by pulling of said slide arm from the retracted position to the extended position, whereby the top newspaper in the stack is delivered to said slot each time said slide arm is pulled to the extended position;

a display case adapted to receive a newspaper display copy and having a window for displaying the display copy, said display case being mounted on said housing for movement between an open position wherein access is provided for removal of the display copy and a closed position wherein the display copy is inaccessible but is visible through said window;

releasable latch means for latching said display case in the closed position; and means for automatically releasing said latch means when said tray is empty and said slide arm is pulled to the extended position, thereby permitting movement of said display case to the open position to provide access to the display copy.

10. A newspaper vending machine comprising:

a housing defining an enclosed interior and having a front portion presenting an outlet slot for dispensing newspapers one at a time;

a substantially horizontal newspaper tray supported within said housing for generally vertical movement therein, said tray being adapted to receive and hold a stack of newspapers;

a normally locked door on said housing providing access to said tray when open to permit a stack of newspapers to be deposited on the tray;

a slide member supported on the housing for fore and aft sliding movement between an extended position and a retracted position, said slide member having a handle thereon at an accessible location for pulling of the slide member to the extended position;

means for biasing said slide member toward the retracted position;

yieldable means for urging said tray upwardly;

a ski member flexibly coupled with said slide member for movement therewith and having a sole plate overlying said tray in contact with the upper side of the top newspaper in the stack deposited on said tray, said ski member having a pair of pointed prongs for penetrating the top newspaper and feeding same to said outlet slot in response to movement of said slide member to the extended position, said ski member also including a link member having an upper end pivotally coupled with said slide member and a lower end coupled with said sole plate;

means on said housing in contact with the upper surface of the top newspaper as same is being fed toward the outlet slot; and a roller on said ski member disposed in rolling contact with the top newspaper in the stack during return movement of the ski member away from the outlet slot as said slide member returns to the retracted position.

11. A machine as set forth in claim 10, including a plurality of cleats on said ski member located below said sole plate for engaging the back edge portion of the top newspaper to assist in feeding same to the outlet slot.

12. A machine as set forth in claim 11, including means for adjusting the distance between said cleats and sole plate.

13. A newspaper vending machine comprising:

a housing defining an enclosed interior and having a front portion presenting an outlet slot for dispensing newspapers one at a time;

a substantially horizontal newspaper tray supported within said housing for generally vertical movement therein, said tray being adapted to receive and hold a stack of newspapers;

a normally locked door on said housing providing access to said tray when open to permit a stack of newspapers to be deposited on the tray;

a slide member supported on the housing for fore and aft sliding movement between an extended position and a retracted position, said slide member having a handle thereon at an accessible location for pulling of the slide member to the extended position;

yieldable means for urging said tray upwardly;

a ski member flexibly coupled with said slide member for movement therewith and having a sole plate overlying said tray in contact with the upper side of the top newspaper in the stack deposited on said tray, said ski member having means for engaging the top newspaper and feeding same to said outlet slot in response to movement of said slide member to the extended position, said ski member also including a link member having an upper end pivotally coupled with said slide member and a lower end coupled with said sole plate;

means on said housing in contact with the upper surface of the top newspaper as same is being fed toward the outlet slot; and a roller on said ski member disposed in rolling contact with the top newspaper in the stack during return movement of the ski member away from the outlet slot as said slide member returns to the retracted position;

a display case having a transparent window for displaying a newspaper display copy deposited in the case;

means for mounting said display case on the housing for movement between an open position wherein access is provided to the display copy and a closed position wherein the display copy is inaccessible but is displayed through said window;

a latch normally latching said display case in the closed position but releasable to unlatch said display case to permit same to move to the open position; and means for releasing said latch to open the display case when said tray is empty and said ski member is moved toward said outlet slot.

14. The improvement set forth in claim 13, wherein said releasing means includes an extension on said ski member bypassing said latch when the ski member is moved toward the outlet slot with at least one newspaper on the tray, said extension contacting the latch in a manner to release same when the ski member is moved toward the outlet slot with the tray empty.

* * * * *